US009856615B1

(12) United States Patent
Neusch

(10) Patent No.: US 9,856,615 B1
(45) **Date of Patent: *Jan. 2, 2018**

(54) WEDGE VEHICLE BARRIER

(71) Applicant: Neusch Innovations, LP, Marble Falls, TX (US)

(72) Inventor: William H. Neusch, Marble Falls, TX (US)

(73) Assignee: Neusch Innovations, LP, Marble Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/716,172

(22) Filed: Sep. 26, 2017

Related U.S. Application Data

(63) Continuation of application No. 14/925,678, filed on Oct. 28, 2015, now Pat. No. 9,771,696.

(60) Provisional application No. 62/069,798, filed on Oct. 28, 2014.

(51) Int. Cl.
*E01F 13/08* (2006.01)
*E01F 13/12* (2006.01)

(52) U.S. Cl.
CPC ..... *E01F 13/123* (2013.01); *E01F 13/08* (2013.01)

(58) Field of Classification Search
CPC ..... E01F 13/00; E01F 13/126; E01F 13/10; E01F 13/08; E01F 13/123
See application file for complete search history.

(56) References Cited

U.S. PATENT DOCUMENTS

| | | | |
|---|---|---|---|
| 3,503,480 | A | 3/1970 | Selby, Jr. |
| 4,354,771 | A | 10/1982 | Dickinson |
| 4,490,068 | A | 12/1984 | Dickinson |
| 4,627,763 | A | 12/1986 | Roemer et al. |
| 4,630,395 | A | 12/1986 | Nasatka |
| 4,705,426 | A | 11/1987 | Perea |
| 4,752,152 | A | 6/1988 | Crisp et al. |
| 4,826,349 | A | 5/1989 | Nasatka |
| 4,828,424 | A | 5/1989 | Crisp |
| 4,861,185 | A | 8/1989 | Eikelenboon |
| 5,228,237 | A | 7/1993 | Nasatka |
| 7,048,467 | B2 | 5/2006 | Burns et al. |
| 7,101,112 | B2 | 9/2006 | Burns et al. |
| 7,118,304 | B2 | 10/2006 | Turpin et al. |
| 7,320,557 | B1 | 1/2008 | Potter |
| 7,950,870 | B1 | 5/2011 | Thompson et al. |
| 8,152,407 | B1 | 4/2012 | Al-Qahtani |
| 8,182,169 | B2 | 5/2012 | Thompson et al. |
| 8,439,594 | B1 | 5/2013 | Clark et al. |
| 8,956,072 | B2 | 2/2015 | Brackin et al. |

(Continued)

FOREIGN PATENT DOCUMENTS

| | | |
|---|---|---|
| WO | 92/01116 A1 | 1/1992 |

OTHER PUBLICATIONS

Written Opinion of the International Searching Authority dated Jan. 21, 2016 in PCT/US2015/057853.

*Primary Examiner* — Abigail A Risic
(74) *Attorney, Agent, or Firm* — Winstead PC

(57) ABSTRACT

A wedge barrier system includes a frame to be disposed within a foundation, a wedge barrier having fingers with an asset end pivotally connected to the frame at an asset side and a blocking member extending perpendicular to the fingers and connected at threat ends of each of the fingers and a drive actuator to move the wedge barrier between a non-deployed position with the wedge barrier disposed inside the frame and a deployed position with the blocking member located above the top side.

20 Claims, 6 Drawing Sheets

(56) References Cited

U.S. PATENT DOCUMENTS

| | | | |
|---|---|---|---|
| 9,028,166 | B2 | 5/2015 | Morgan |
| 9,228,304 | B2 | 1/2016 | Brackin et al. |
| 2004/0033106 | A1 | 2/2004 | Turpin et al. |
| 2005/0214072 | A1 | 9/2005 | Turpin et al. |
| 2006/0078378 | A1 | 4/2006 | Burns |
| 2010/0196093 | A1 | 4/2010 | Seeglitz |
| 2013/0045047 | A1 | 2/2013 | Morgan et al. |
| 2014/0234024 | A1 | 8/2014 | Brakin et al. |

WEDGE VEHICLE BARRIER

CROSS-REFERENCES TO RELATED APPLICATIONS

This application is a continuation of Ser. No. 14/925,678, filed on Oct. 28, 2015, which claims the benefit of provisional patent application No. 62/069,798, filed Oct. 28, 2014, each of which are incorporated herein by reference in their entirety as if fully set forth herein.

BACKGROUND

This section provides background information to facilitate a better understanding of the various aspects of the disclosure. It should be understood that the statements in this section of this document are to be read in this light, and not as admissions of prior art.

Security barriers are often utilized at motor vehicle entrances into facilities and property. The security barriers provide a means to selectively allow the entry of authorized vehicles. Typically these barriers are temporarily deployed to stop vehicles prior to confirming that the occupants and/or contents are authorized for entry and withdrawn to allow vehicles to pass. These barriers generally designed to withstand a ramming force from a motor vehicle when deployed.

SUMMARY

A wedge vehicle barrier system according to aspects of the disclosure includes a frame having a top side, a laterally extending beam trough located along a threat side, and laterally spaced apart finger troughs extending from an asset side to the beam trough, each of the finger troughs being open at the top side of the frame and formed between a respective pair of rails, a first cavity formed between a first pair of the laterally spaced apart finger troughs and a second cavity formed between a second pair of the laterally spaced apart finger troughs; and a wedge barrier having fingers aligned with the finger troughs, each finger having an asset end pivotally connected to the frame and a blocking member extending perpendicular to the fingers and connected at threat ends of each of the fingers. The wedge barrier is moveable between a non-deployed position with the wedge barrier disposed in the finger and beam troughs and a deployed position with the blocking member located above the top side. When wedge vehicle barrier system is installed the frame is disposed within a foundation having a surface level (substantially level) with the top side of the frame and the foundation is disposed within one or more of the cavities located between the adjacent finger troughs.

In accordance to at least one embodiment a wedge vehicle barrier system includes a frame having a top side, a laterally extending asset-side wall and a laterally extending threat-side wall, the asset-side and the threat-side walls extending parallel to one another, a laterally extending beam trough located along the threat-side wall, laterally spaced apart finger troughs extending from the asset-side wall to the beam trough, wherein each of the finger troughs is open at the top side of the frame and formed between a pair of rails, and cavities located between the adjacent finger troughs and open at the top side of the frame; a wedge barrier with fingers aligned with the finger troughs, each of the fingers having an asset end pivotally connected to the frame and a blocking member extending perpendicular to the fingers and connected at threat ends of each of the fingers and each of the fingers having a linkage connected at a first end to the finger and at a second end to the frame, the linkage extending into the respective finger trough. The wedge barrier is moveable between a non-deployed position with the wedge barrier disposed in the finger and beam troughs and a deployed position with the blocking member located above the top side.

A vehicle wedge barrier system includes a frame having a top side, a laterally extending beam trough located along a threat side, and laterally spaced apart finger troughs extending from an asset side to the beam trough, each of the finger troughs open at the top side of the frame and formed between a respective pair of rails; a first cavity formed between a first pair of the laterally spaced apart finger troughs; a rod extending from the frame and disposed in the first cavity; a second cavity formed between a second pair of the laterally spaced apart finger troughs; a rod extending from the frame and disposed in the second cavity; and a wedge barrier comprising fingers aligned with the finger troughs, each of the fingers having an asset end pivotally connected to the frame, and a blocking member extending perpendicular to the fingers and connected at threat ends of each of the fingers; a drive actuator connected to the wedge barrier to move the wedge barrier between a non-deployed position with the wedge barrier disposed in the finger and beam troughs and a deployed position with the blocking member located above the top side; and each of the fingers comprises a linkage connected at a first end to the finger and at a second end to the frame, the linkage extending into the respective finger trough.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
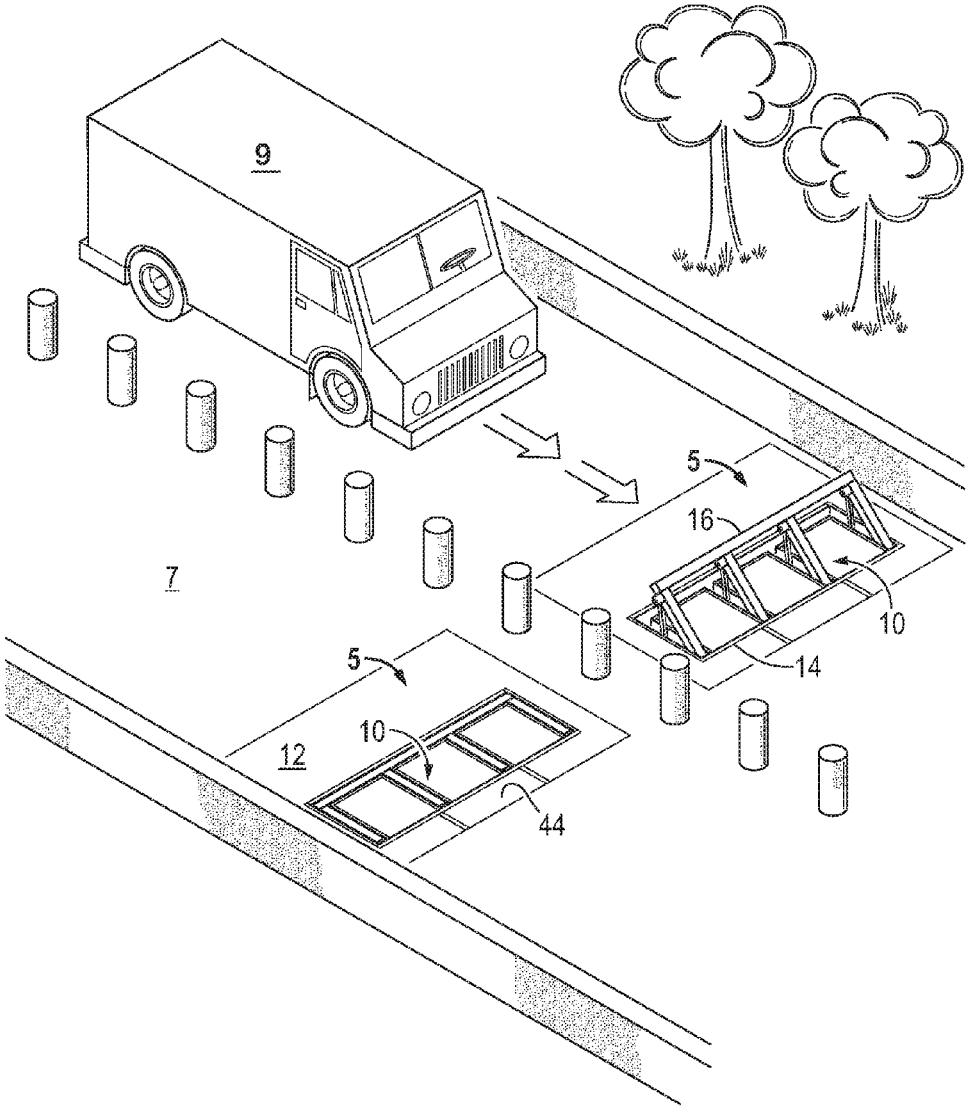
FIG. 1 illustrates an active wedge barrier system incorporated in a roadway in accordance to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface of a roadway.

Referring to FIG. 1, anti-ram active wedge vehicle barrier systems, generally denoted by the numeral 5, are illustrated incorporated into a roadway 7 for example at an entry point to a high security area. With additional reference to FIGS. 2 to 10, the wedge barrier system 5 includes a wedge barrier 10 that is mounted in a foundation 12 and installed in the roadway. For example, the wedge barrier 10 is pivotally connected with a foundation frame 14 that is located in the foundation so as to be pivoted from a non-deployed position as shown in the bottom lane of roadway 7 to a deployed position as illustrated in the top lane of roadway 7 to prevent the motor vehicle 9 approaching from an attack side from crossing the barrier to the asset side. In the deployed position a blocking member 16, e.g., beam, of the wedge barrier 10 is raised a distance above the surface (i.e., grade) of the roadway 7, for example to a blocking height of about 36 inches. In the non-deployed position as illustrated in the bottom lane of roadway 7 the wedge barrier 10 is recessed into the foundation 12 so as to be flush or substantially flush with the surface or grade 20 (FIG. 3) of the foundation and roadway. For example, the wedge barrier 10 extends no more than about 0.5 inches above the roadway surface.

In accordance to embodiments the wedge barrier 10 is a shallow mount system, for example the foundation 12 may be limited to about twelve inches or less in vertical depth. In some embodiments, the roadway 7 may be prepared for installation of a wedge barrier system 5 by excavating to a depth of about twelve inches.

In accordance with at least some embodiments the barrier can be actuated from the non-deployed to the deployed position in less than about 2 seconds in emergency operations. Additionally the actuating or drive mechanism is intended to provide for routine raising and lowering of the wedge barrier 10, for example in some embodiments the barrier and driving mechanism are capable of at least 120 complete cycles per hour. In accordance to one or more embodiments the wedge barrier system 5 meets ASTM F2656 Condition/Penetration Rating M50/P1, which allows penetration of less than or equal to 3.3 feet when impacted by a medium-duty truck (e.g., 6,800 kg) at 50 miles per hour.

Figure 2:
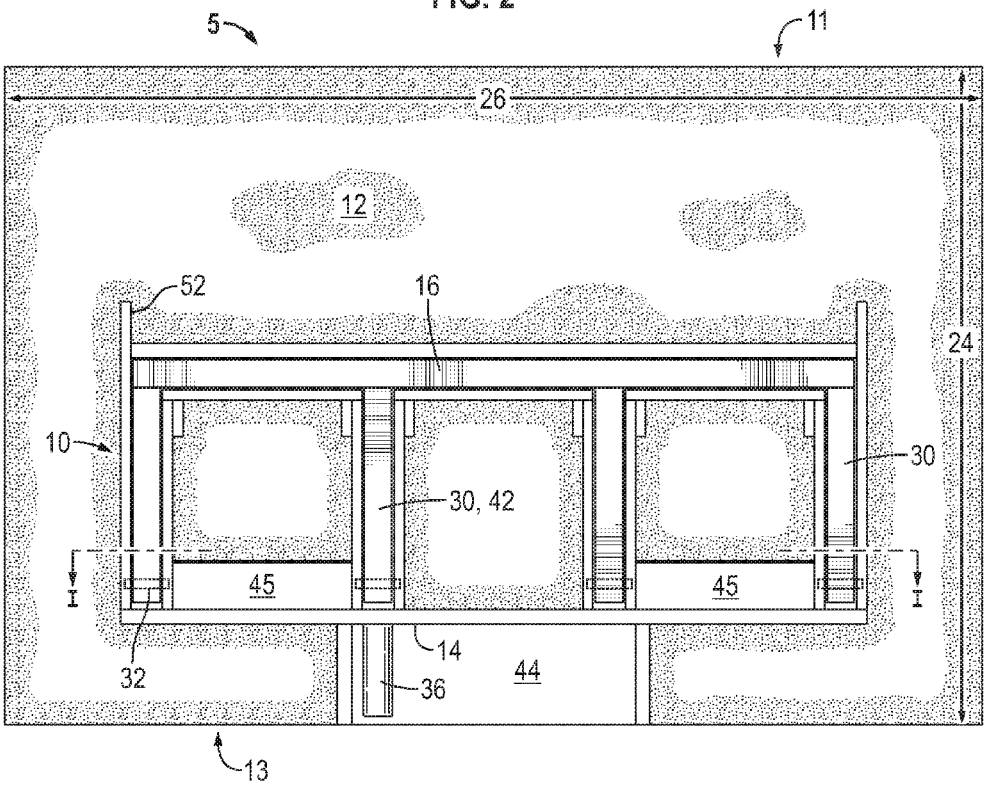
FIG. 2 is a plan view of an active wedge barrier system in accordance to one or more aspects of the disclosure.
Figure 3:
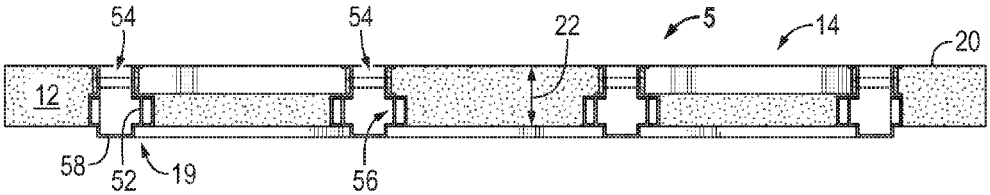
FIG. 3 illustrates a portion of the active wedge barrier system along the line I-I of FIG. 2 in accordance to one or more aspects of the disclosure.

FIG. 2 is a plan view of active wedge vehicle barrier system 5 in accordance to an embodiment and FIG. 3 is a view along the line I-I of FIG. 2 with the wedge barrier 10 removed to illustrate the foundation frame 14 and foundation 12. Foundation 12 is constructed of a concrete, and in some embodiments the concrete may not utilized reinforcement bars. In some embodiments the foundation frame 14 may include rods 72 (FIG. 9) extending from the foundation frame 14 and into the concrete foundation 12. The foundation frame 14 may be located in a hole excavated in the roadway 7. Concrete foundation 12 can be poured such that the top side 18 of the foundation frame 14 is substantially level with the surface 20 of foundation 12 as described for example with reference to FIG. 1. In one or more embodiments, the concrete foundation 12 may be formed with the foundation frame 14 at a location remote from the install site. In accordance to some embodiments the active wedge barrier system 5 eliminates the need for placement of reinforcement bars and for hot work at the installation site. In practice the active wedge barrier systems 5 are designed to have an installation time of less than one day.

In accordance to an embodiment the foundation 12 is constructed of a concrete having a strength for example of about 3,500 PSI or greater. The depth 22 of the foundation may be for example about 12 inches. A lower portion of the foundation frame 14 may extend below the concrete foundation 12 into a substrate for example to provide for water drainage. The length 24 from the threat or attack side 11 of the foundation 12 to the asset side 13 of the foundation 12 may be for example about twelve feet. The width 26 of the foundation 12 varies with the lateral length of the blocking member 16, i.e., the width of the wedge barrier 10. Standard width barriers are no less than about 8 feet and no more than about 14 feet 6 inches, although other width barriers may be utilized. In the depicted FIG. 2 the width 26 of the foundation 12 is for example about 12 feet for a blocking member 16 width 28 (FIG. 8) of 8 feet. In accordance to at least one embodiment, the width 26 of the foundation 12 is about 18 feet 6 inches for a width 28 of the wedge barrier 10 of about 14 feet 6 inches.

The blocking member 16 has a length 28 (FIG. 8) that forms the lateral width of the wedge barrier 10. One or more lights 55 (FIGS. 4, 5, 9 and 10) may be connected to the wedge barrier 10, for example to the blocking member 16. In accordance to aspects of the disclosure, the lights 55 may be located in a position to be visible from both the attack side and the asset side when the wedge barrier is raised. The blocking member 16 is supported by and pivotally connected to the foundation frame 14 by support members 30, also referred to from time to time as fingers members. In accordance to some embodiments the hinge system includes a greaseless bushing system. In the depicted embodiments, four support members 30 are utilized with a blocking member length of 8 feet and 14 feet 6 inches. In at least one embodiment, the blocking member 16 is constructed for example of a 6-inch by 6-inch steel member and the support members 30 are I-beam structures.

Figure 4:
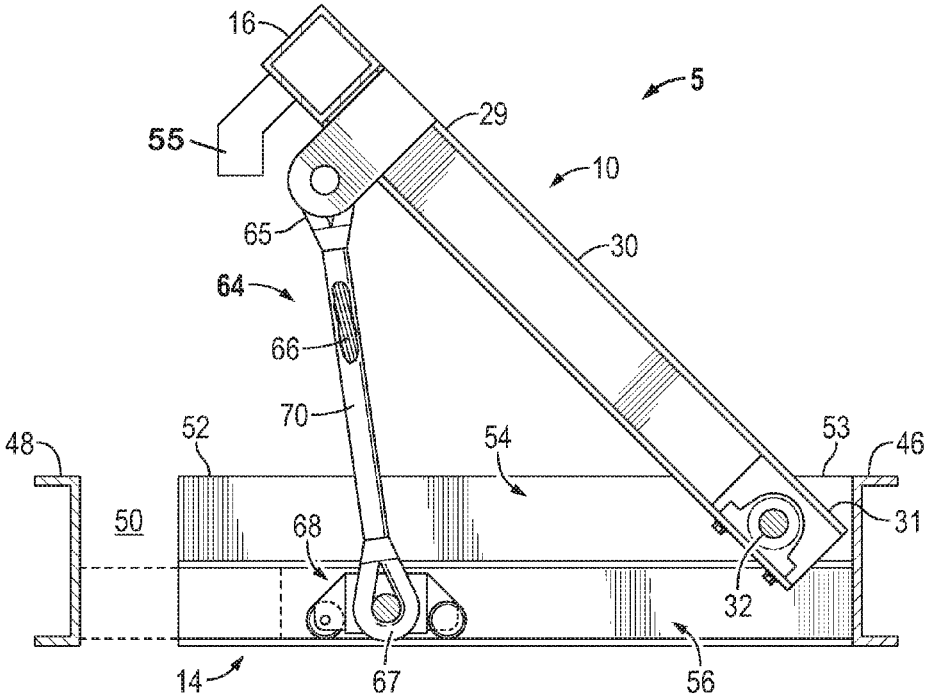
FIG. 4 is a side view through a finger trough portion of an active wedge barrier system that is in a raised or deployed position in accordance to one or more aspects of the disclosure.
Figure 5:
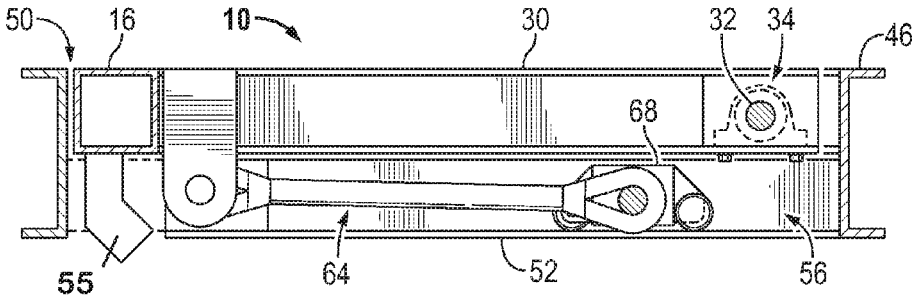
FIG. 5 is a side view through a finger trough portion of an active wedge barrier system that is in a non-deployed position in accordance to one or more aspects of the disclosure.

The support members 30 are spaced apart and extend perpendicular to the blocking member 16. Each support member 30 has a threat or attack end 29 connected (e.g. welded) to the blocking member 16 and an asset end 31 that is pivotally connected to the foundation frame 14, for example by a pin 32. The pins 32 may be part of a hinge system such as bearings 34, for example pillow block bearings as illustrated in FIGS. 4 and 5. For example, two bearings 34 for each finger member 30 may be utilized.

Figure 6:
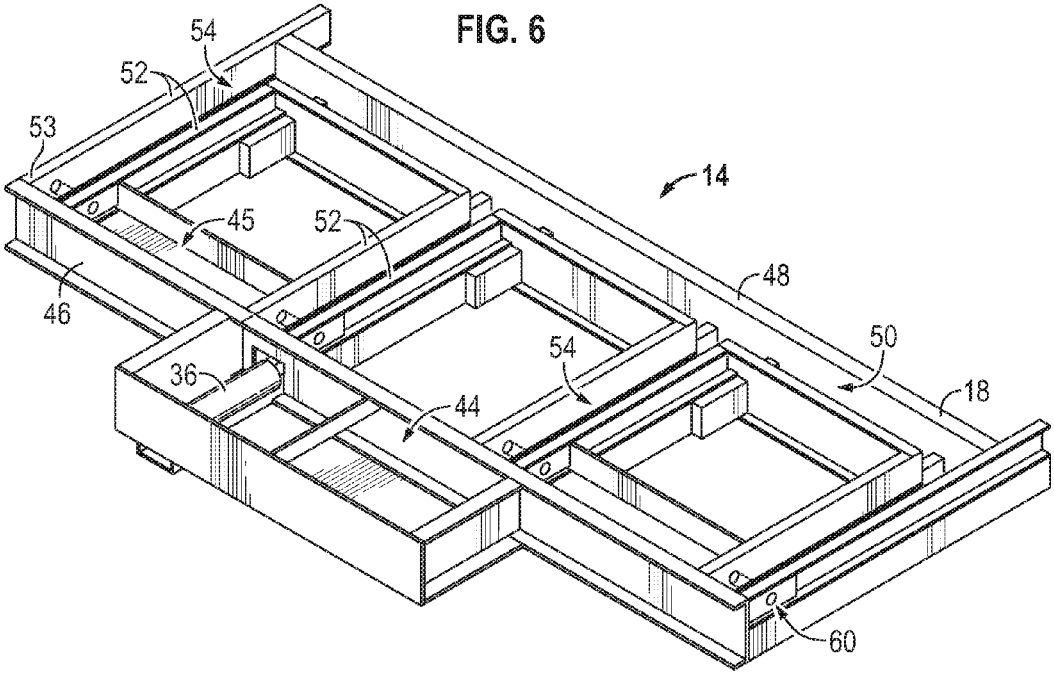
FIG. 6 illustrates a foundation frame of an active wedge barrier system in accordance to one more aspects.
Figure 8:
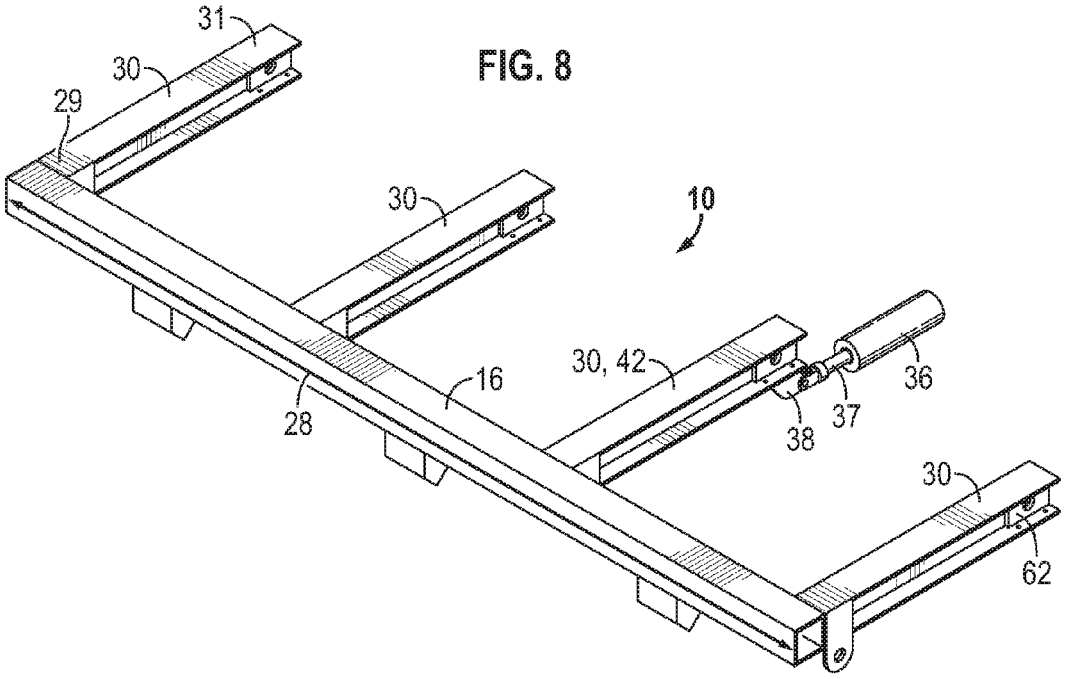
FIG. 8 illustrates a wedge barrier and actuating device in isolation in accordance to one or more aspects of the disclosure.

At least one of the support members 30 is operationally connected to drive mechanism 36, which is illustrated for example in FIGS. 2, 6 and 8. The drive mechanism 36 is positioned below the top side 18 of the foundation frame 14 and connected to the support member(s) 30 below the top surface of the foundation frame and below the surface 20 of the foundation 12. Drive mechanism 36 is a linear mechanism such as, and without limitation, a screw actuator and motor or a hydraulic ram. One example of a motor is an IP68 electromechanical stainless steel motor. In accordance to embodiments there is no spring other assistance, e.g., compressed air, needed for operation.

In FIG. 8 the linear drive mechanism 36 is shown having a linear shaft 37 which is attached at a connection plate 38 located on the bottom side 40 of the support member 30 identified specifically as the lifting support member 42 (e.g., lifting finger). In the depicted embodiment, a single drive mechanism 36 is used to actuate the wedge barrier 10 between the deployed and non-deployed positions. Drive mechanism 36 is located in a compartment 44 (FIGS. 1, 2, 6) of the foundation frame on the asset side of the wedge barrier, i.e. on the opposite end of support members 30 from blocking member 16. This compartment 44 may be covered with a lid, e.g., a steel plate, for example as illustrated in FIG. 1 so as to be accessible from the surface for repair and maintenance.

In FIG. 6 the drive mechanism 36 is located behind the asset-side wall 46 with a shaft of the drive mechanism extending through the asset-side wall 46 to connect to the wedge barrier 10 as illustrated in FIG. 8. The location of the drive mechanism 36 behind the asset-side wall provides protection to the mechanism for example from explosives when the wedge barrier is in the deployed position. The location and use of a linear drive also facilitates repair and replacement of the drive mechanism when the wedge barrier 10 in the non-deployed position. Compartment 44 also serves as a position to locate control elements, such as electronics, processors, and the like.

Referring to FIG. 6 an example of a foundation frame 14 is described in conjunction with the other figures. The depicted foundation frame 14 includes a laterally extending rear, asset-side wall 46 and a front, threat or attack-side wall 48 that extend for example parallel to one another. In FIG. 6 the asset and threat walls 46, 48 comprise for example structural steel channel. A lateral beam trough 50 is formed long the inside of the attack-side wall 48 to dispose the blocking member 16 when the wedge barrier is in the non-deployed position, see e.g., FIG. 5. Rails 52 are connected, e.g., welded, at an asset end 53 to the inside of the asset-side wall 46 and extend toward the attack-side wall 48. The outer most rails 52 extend to the attack-side wall 48 and as illustrated in FIGS. 2 and 6 beyond the attack-side wall 48. The attack-side wall 48 may be connected to the outer most rails 52.

Rails 52 are arranged in cooperative pairs, each pair of rails forming a finger trough 54 sized to dispose one of the finger support members 30. With reference in particular to FIG. 3, each pair of rails 52 also forms an anchor track or channel 56 immediately below the finger trough 54. The anchor track or channel 56 may have a wider lateral opening than the finger trough 54 for trapping a sliding anchor as further described below with reference to FIGS. 4 and 5. As illustrated in FIG. 3, the cooperative pairs of rails 52 may be connected at a bottom side 19 of the foundation frame by a floor 58. An orifice 60 is shown formed through the asset ends 53 of the rails for passing the pin 32 (FIG. 2) to pivotally connect the support members 30. FIGS. 2 and 6 also illustrate surface accessible compartments 45 formed by the foundation frame and extending between the asset ends 53 of the rails 52 of adjacent finger troughs 54 to provide surface access to the hinged connection of the finger supports to the foundation frame.

Figure 7:
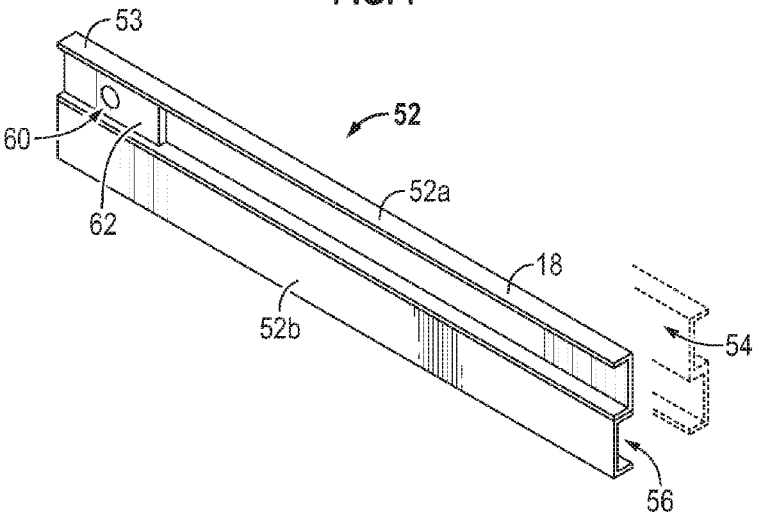
FIG. 7 illustrates in isolation a rail member utilized to form a finger trough portion of a foundation frame in accordance to one or more aspects of the disclosure.

FIG. 7 illustrates an example of a rail 52 formed by opposite facing c-channel structural members (52*a*, 52*b*) stacked on top of one another and interconnected, e.g., by welding, with the open sides of the respective channel members facing away from each other so that the finger trough 54 and the anchor channel 56 will have different widths. The orifice 60 for disposing the hinge pin for connection of the wedge barrier is formed through the top structural member 52*a* at the asset end 53. In some embodiments a reinforcement plate 62 is attached to the rail 52 with the port 60 formed through the plate and the rail. The reinforcement plate 62 can provide additional strength to withstand the force of a motor vehicle impacting the deployed wedge barrier. In FIG. 8 reinforcement plates 62 are also shown attached at the asset ends 31 of the support members 30 to provide additional strength around the hole through which the hinge pin is disposed.

Figure 9:
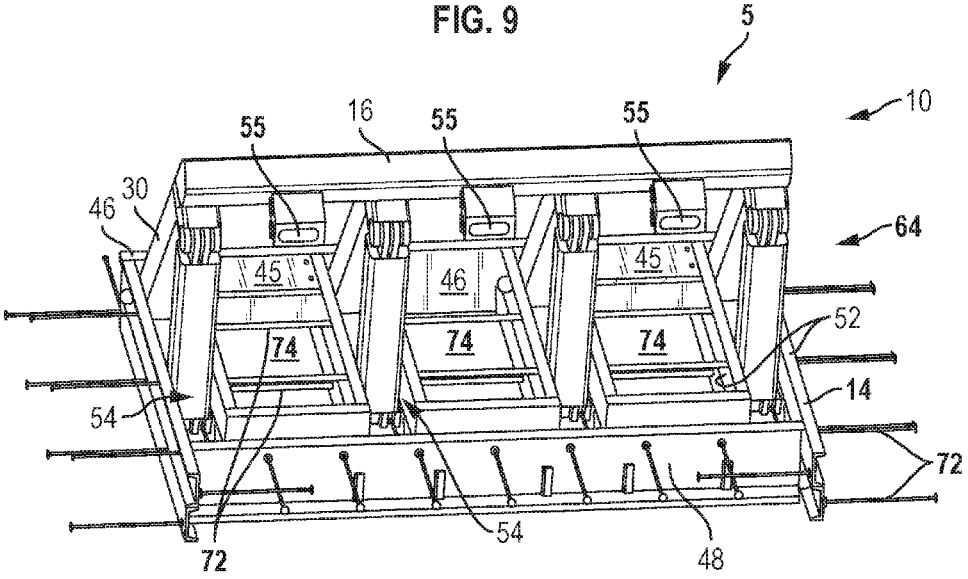
FIG. 9 illustrates a wedge barrier system in accordance to one or more aspects of the disclosure.
Figure 10:
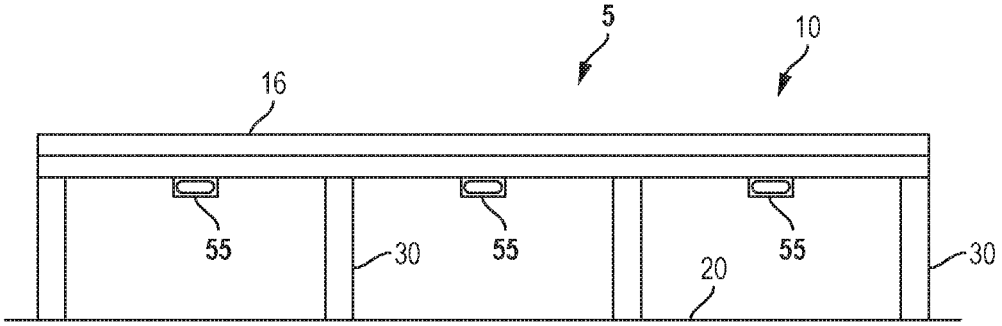
FIG. 10 illustrates an elevation view of a wedge barrier system in accordance to one or more aspects of the disclosure.

Referring in particular to FIGS. 4, 5 and 9, in conjunction with the other figures, an impact absorbing linkage 64 is shown connecting the wedge barrier 10 to the foundation frame 14. For example, absorbing linkage 64 includes one or more cables 66 (e.g., wire rope) connected at a first end 65 to the attack end 29 of the finger support member 30 and connected at a second end to a sliding anchor 68 which is disposed in the anchor channel 56. Sliding anchor 68 may be a block or other device trapped in and axially moveable along the channel 56. A sleeve 70, e.g., conduit, may be disposed about the one or more cables 66 between the first and second ends 65, 67 to provide some rigidity to the cables for example to assist in moving the sliding anchor 68 when actuating the wedge barrier 10 between the deployed and non-deployed positions.

FIG. 9 is a perspective view of a wedge barrier system 5 in accordance to one or more embodiments of the disclosure. The illustrated foundation frame 14 includes rods 72 extending from the frame and through the openings or cavities 74 located inside of the foundation frame between the adjacent laterally spaced apart finger troughs 54. One or more of the cavities 74 may be filled with concrete foundation 12 as illustrated for example in FIGS. 1 and 2.

The following test data is illustrative of an active wedge barrier system 5 in accordance to embodiments of this disclosure. A wedge barrier 10 having a lateral width of 8 feet was impacted by an International, medium duty truck, having a gross vehicle weight of 6,837 kg according to ASTM F2656-07 M50 standards. The wedge barrier was installed in a foundation with an excavation depth of 12 inches, a distance 24 (FIG. 2) from front to back of 12 feet and distance 26 from side to side of 12 feet with concrete having a minimum strength of 3,500 PSI. The tested wedge barrier system satisfied the ASTM F2656-07 Condition/Penetration Rating M50/P1which allows less than 33 feet. The wedge barrier 10 stopped the motor vehicle traveling at a speed of 49.7 miles per hour, the barrier remaining intact and the opening remaining blocked by the wedge barrier.

After the impact the truck's engine was not running, the vehicle was not drivable and a follow on vehicle could not pass the wedge barrier.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A wedge vehicle barrier system, comprising:

a frame having a top side, a laterally extending beam trough located along a threat side, and laterally spaced apart finger troughs extending from an asset side to the beam trough, wherein each of the finger troughs is open at the top side of the frame and formed between a respective pair of rails;

a first cavity formed between a first pair of the laterally spaced apart finger troughs;

a second cavity formed between a second pair of the laterally spaced apart finger troughs; and a wedge barrier comprising fingers aligned with the finger troughs, each of the fingers having an asset end pivotally connected to the frame, and a blocking member extending perpendicular to the fingers and connected at threat ends of each of the fingers, wherein the wedge barrier is moveable between a non-deployed position with the wedge barrier disposed in the finger and beam troughs and a deployed position with the blocking member located above the top side.

2. The system of claim 1, comprising a linkage having a first end connected to the wedge barrier and a second end connected to the frame.

3. The system of claim 1, comprising a linkage having a first end connected to the wedge barrier and a second end connected to the frame, the linkage extending within one of the finger troughs.

4. The system of claim 1, wherein each of the fingers comprises a linkage connected at a first end to the finger and at a second end to the frame, the linkage extending into the respective finger trough.

5. The system of claim 1, comprising a drive actuator connected to the wedge barrier to move the wedge barrier between the deployed position and the non-deployed position, wherein the drive actuator is located below the top side of the frame when the wedge barrier is in the deployed position and the non-deployed position.

6. The system of claim 1, comprising a linear drive actuator connected to the wedge barrier to move the wedge barrier between the deployed position and the non-deployed position, the linear drive actuator comprising a linear shaft in connection with the wedge barrier, wherein the linear drive actuator and the linear shaft are located below the top side of the frame when the wedge barrier is in the deployed position and the non-deployed position.

7. The system of claim 1, comprising a linkage having a first end connected to the wedge barrier and a second end connected to the frame; and a drive actuator connected to the wedge barrier to move the wedge barrier between the deployed position and the non-deployed position, wherein the drive actuator is located below the top side of the frame when the wedge barrier is in the deployed position and the non-deployed position.

8. The system of claim 1, comprising a drive actuator connected to the wedge barrier to move the wedge barrier between the deployed position and the non-deployed position, wherein the drive actuator is located below the top side of the frame when the wedge barrier is in the deployed position and the non-deployed position; and each of the fingers comprising a linkage connected at a first end to the finger and at a second end to the frame, the linkage extending into the respective finger trough.

9. The system of claim 1, comprising a linear drive actuator connected to the wedge barrier to move the wedge barrier between the deployed position and the non-deployed position, the linear drive actuator comprising a linear shaft in connection with the wedge barrier, wherein the linear drive actuator and the linear shaft are located below the top side of the frame when the wedge barrier is in the deployed position and the non-deployed position; and each of the fingers comprises a linkage connected at a first end to the finger and at a second end to the frame, the linkage extending into the respective finger trough.

10. The system of claim 1, comprising a light connected to the wedge barrier, wherein the light is visible from the asset side and the threat side when the wedge barrier is in the deployed position.

11. The system of claim 1, comprising a light connected to the wedge barrier, wherein the light is visible from the asset side and the threat side when the wedge barrier is in the deployed position;

a linkage having a first end connected to the wedge barrier and a second end connected to the frame; and a drive actuator connected to the wedge barrier to move the wedge barrier between the deployed position and the non-deployed position, wherein the drive actuator is located below the top side of the frame when the wedge barrier is in the deployed position and the non-deployed position.

12. The system of claim 1, wherein the frame is disposed within a foundation having a surface substantially level with the top side of the frame and the foundation is disposed within the first cavity and the second cavity.

13. The system of claim 12, comprising a linkage having a first end connected to the wedge barrier and a second end connected to the frame; and a drive actuator connected to the wedge barrier to move the wedge barrier between the deployed position and the non-deployed position, wherein the drive actuator is located below the top side of the frame when the wedge barrier is in the deployed position and the non-deployed position.

14. The system of claim 12, comprising a drive actuator connected to the wedge barrier to move the wedge barrier between the deployed position and the non-deployed position, wherein the drive actuator is located below the top side of the frame when the wedge barrier is in the deployed position and the non-deployed position; and each of the fingers comprising a linkage connected at a first end to the finger and at a second end to the frame, the linkage extending into the respective finger trough.

15. A method, comprising:

providing a vehicle wedge barrier system to be installed with a concrete foundation, the vehicle wedge barrier system comprising:

a frame having a top side, a laterally extending beam trough located along a threat side, and laterally spaced apart finger troughs extending from an asset side to the beam trough, wherein each of the finger troughs is open at the top side of the frame and formed between a respective pair of rails;

a first cavity formed between a first pair of the laterally spaced apart finger troughs, the first cavity open at the top side;

a rod extending from the frame and disposed in the first cavity;

a second cavity formed between a second pair of the laterally spaced apart finger troughs, the second cavity open at the top side;

a rod extending from the frame and disposed in the second cavity; and a wedge barrier comprising fingers aligned with the finger troughs, each of the fingers having an asset end pivotally connected to the frame, and a blocking member extending perpendicular to the fingers and connected at threat ends of each of the fingers;

a drive actuator connected to the wedge barrier to move the wedge barrier between a non-deployed position with the wedge barrier disposed in the finger and beam troughs and a deployed position with the blocking member located above the top side; and each of the fingers comprises a linkage connected at a first end to the finger and at a second end to the frame, the linkage extending into the respective finger trough.

16. The method of claim 15, wherein the drive actuator is a linear drive actuator comprising a linear shaft, the linear shaft in connection with the wedge barrier, wherein the linear drive actuator is located below the top side of the frame when the wedge barrier is in the deployed position and the non-deployed position.

17. A wedge vehicle barrier system, comprising:

a frame having a top side, a laterally extending asset-side wall and a laterally extending threat-side wall, the asset-side and the threat-side walls extending parallel to one another, a laterally extending beam trough located along the threat-side wall, laterally spaced apart finger troughs extending from the asset-side wall to the beam trough, wherein each of the finger troughs is open at the top side of the frame and formed between a pair of rails, and cavities located between the adjacent finger troughs and open at the top side of the frame;

a wedge barrier comprising fingers aligned with the finger troughs, each of the fingers having an asset end pivotally connected to the frame, and a blocking member extending perpendicular to the fingers and connected at threat ends of each of the fingers, wherein the wedge barrier is moveable between a non-deployed position with the wedge barrier disposed in the finger and beam troughs and a deployed position with the blocking member located above the top side; and each of the fingers comprising a linkage connected at a first end to the finger and at a second end to the frame, the linkage extending into the respective finger trough.

18. The system of claim 17, comprising a light connected to the wedge barrier, wherein the light is visible from the asset side and the threat side when the wedge barrier is in the deployed position.

19. The system of claim 17, further comprising a rod extending from the frame and disposed within at least one of the cavities.

20. The system of claim 17, comprising a drive actuator connected to the wedge barrier to move the wedge barrier between the deployed and the non-deployed positions; and the frame disposed within a foundation having a surface substantially level with the top side of the frame, the foundation disposed within at least one of the cavities.

* * * * *